United States Patent [19]

Shiue

[11] Patent Number: 4,766,754

[45] Date of Patent: Aug. 30, 1988

[54] CONTINUOUS PROCESS FOR BENDING LONG RODS OR TUBES

[75] Inventor: Sang R. Shiue, Kaohsiung, Taiwan

[73] Assignee: Watt Yang, Kaosiung Hsieng, Taiwan; a part interest

[21] Appl. No.: 40,080

[22] Filed: Apr. 20, 1987

Related U.S. Application Data

[62] Division of Ser. No. 856,798, Apr. 28, 1986.

[51] Int. Cl.[4] ..... B21D 7/022; B21D 43/20; B21D 43/28

[52] U.S. Cl. ..... 72/294; 72/306; 72/420; 72/424; 72/427; 414/745; 414/748; 221/200; 221/236; 221/266; 198/453; 198/777; 83/161

[58] Field of Search ..... 72/369, 367, 294, 306, 72/307, 420, 424, 427, 388, 216–219, 133, 132, 129; 414/745, 748, 784; 221/200, 201, 203, 236, 266; 198/453, 443, 777, 773

[56] References Cited

U.S. PATENT DOCUMENTS

| | | | |
|---|---|---|---|
| 1,514,589 | 11/1924 | Foisy | 72/424 |
| 2,742,184 | 4/1956 | Yerkes | 221/203 |
| 2,871,909 | 2/1959 | Bower | 72/321 |
| 3,151,747 | 10/1964 | McGoogan | 414/748 |
| 3,195,737 | 7/1965 | Melrose | 414/745 |
| 3,376,725 | 4/1968 | Andrews | 72/424 |
| 3,545,589 | 12/1970 | Keller | 221/200 |
| 3,871,288 | 3/1975 | White | 414/748 |
| 3,920,131 | 11/1975 | Gebel | 414/748 |
| 4,388,039 | 6/1983 | Schwarze | 414/748 |

*Primary Examiner*—Daniel C. Crane
*Attorney, Agent, or Firm*—Holman & Stern

[57] ABSTRACT

A continuous process for bending long metal rods comprises separating and feeding a bundle of rods and advancing the rods one by one to a rod cutting station downstream, cutting the rods and feeding them to a rod bending station downstream of the cutting station, and subsequently bending the rods and removing them from the machine.

6 Claims, 18 Drawing Sheets

CONTINUOUS PROCESS FOR BENDING LONG RODS OR TUBES

This is a divisional of application Ser. No. 856,798 filed Apr. 28, 1986.

BACKGROUND OF THE INVENTION

1. Field of the Invention

This invention relates to a continuous process for bending long metal rods, particularly for bending reinforcing bars used in construction.

2. Description of the Prior Art

Conventionally, reinforcement rods used in construction are bent by manual operation or combined manual and machine operation. Since there are large demands for bent reinforcement rods in the construction field, the conventional methods for bending the reinforcement rods which are time-consuming and labor-intensive have been found to be unsatisfactory. Therefore, it is desirable to provide a new method for mass-production of bent reinforcement rods.

SUMMARY OF THE INVENTION

An object of the present invention is to provide a continuous process for bending long metal rods or tubes which requires less time and labor than conventional processes.

The invention achieves this object by providing a continuous process comprising placing a bundle of rods on a support so that the rods are supported at their end portions, holding the rods movably on the support, raising the support to lift the end portions of the rods, vibrating the support and rods thereon and inclining the support to separate the rods and slide them downwardly toward a cutting station, guiding and feeding the rods individually to a cutting station, cutting the rods into desired lengths, feeding the cut rods to a bending station, and bending the rods. A continuous processing machine assembly for carrying out the invention comprises a rod bundle handling unit, a cutting station, a bending station, and transfer units for transferring rods from station to station. The rod bundle handling unit includes a telescopic upright support carrying a movable platform supporting a vibrating support for supporting long metal rods to be bent. A movable cantilever arm is attached to the upright support above the vibrating support for holding movably the rods against the vibrating support. The vibrating support can be raised and vibrated to lift the mid portion of the rods, and separate the rods. Also the vibrating support can be inclined to slide the rods downward. An advancing rotating roller which has axial grooves is attached to the fore end of the vibrating support for receiving and advancing the rods one after another.

The cutting station has a plurality of trucks spaced apart side by side for cooperatively working on each of the advancing rods. The trucks are provided with power drive means so as to be moved relative to one another for adjustment of the intervals between them according to the desired length of the rods, and have means for cutting the rods and means for positioning the rods relative to the rods provided upstream of the cutting means.

The bending station has a plurality of bending devices spaced apart side by side downstream of the cutting station. Each of the bending devices includes a rotary bearing arm mounted on a frame for rotation about a horizontal axis, a power means for rotating the bearing arm, a pressure bending arm extending in space relation from the bearing arm with the axis of the pressure arm parallel to the axis of rotation of the bearing arm, means for mounting the pressure bending arm on the bearing arm, a hydraulic power means for moving radially the pressure arm toward and away from the bearing arm so as to adjust the space between the pressure arm and the bearing arm, and a clamping means mounted on the frame adjacent to the bearing arm and the pressure arm. The pressure arm rotates about the axis of the bearing arm simultaneously with the bearing arm to bend a group of rods.

A take-out device is provided adjacent to each bending device for taking out the rod which is bent by the bending device. The take-out device includes an endless chain which is mounted on a machine frame and capable of moving upward and downward along a cyclical path, means for driving and mounting the endless chain on the frame, an arched rail mounted on the frame and extending from the rear side to the front side of the frame around the endless chain, and a moving support mounted movably on the arched rail and connected to the endless chain. The moving support holds a clamping means employed for clamping the bent rods. When the endless chain is moved, the moving support moves along the arched rail and carries the clamping means from the rear side to the front side of the device, thereby taking out the bent rods from the bending devices.

BRIEF DESCRIPTION OF THE DRAWINGS

The present exemplary preferred embodiment of a machine for carrying out the method of the invention will now be described in detail with reference to the following drawings wherein.

DETAILED DESCRIPTION OF THE INVENTION

Figure 1:
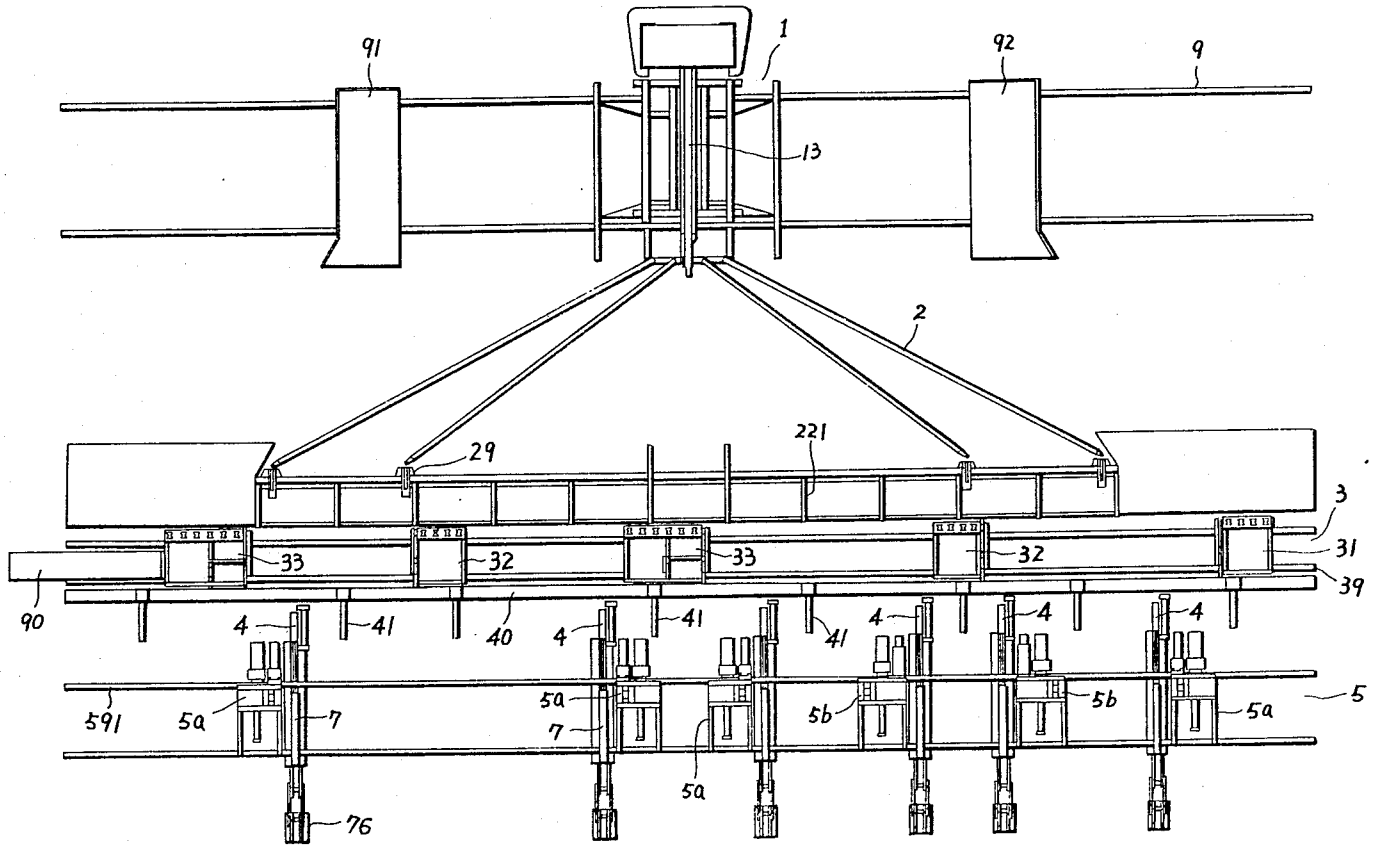
FIG. 1 is a schematic top plan view of a continuous processing machine assembly according to the present invention.

In an embodiment of the present invention, a continuous processing machine for bending long metal rods or tubes, such as reinforcement bars includes, as shown in FIG. 1, a rod bundle handling unit 1, means 2 for advancing long metal rods A one after another to a next station, i.e. a cutting station 3, and a rod bending station 5 downstream of the cutting station.

Figure 3:
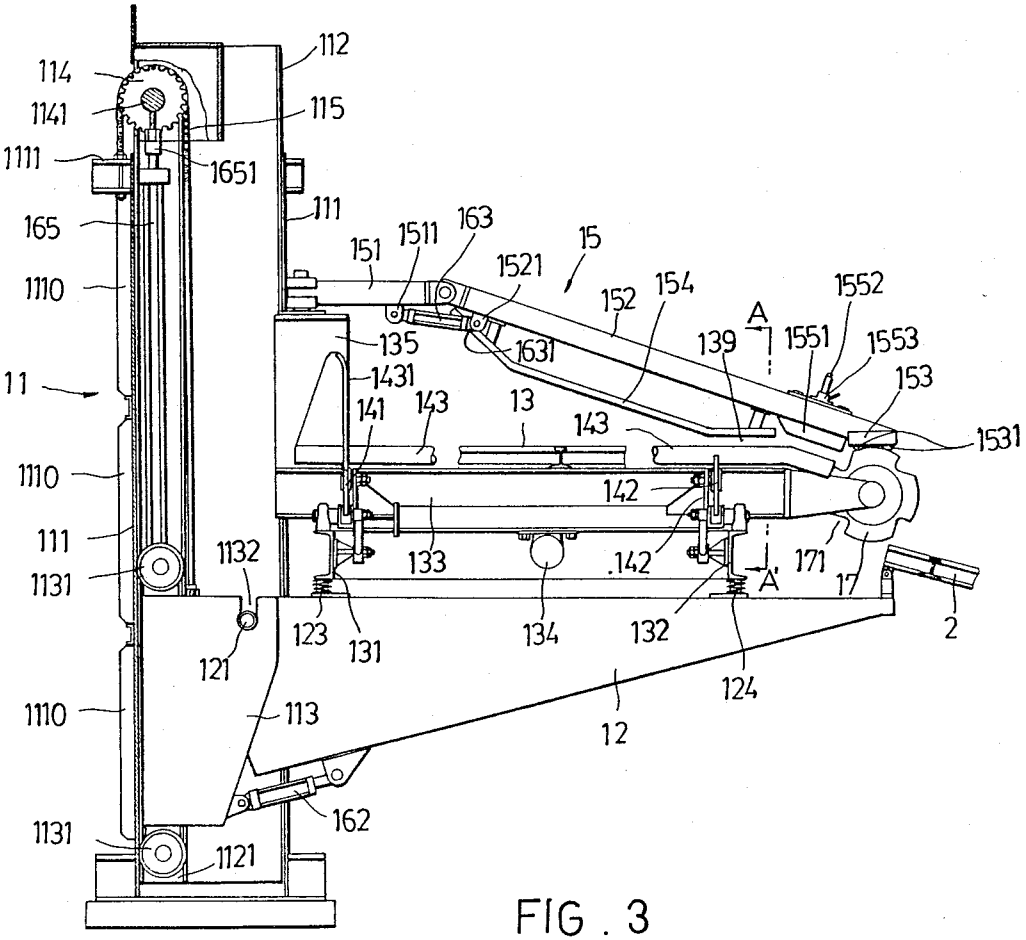
FIG. 3 is an enlarged side elevational view of a rod bundle handling unit of the assembly of FIG. 1.
Figure 4:
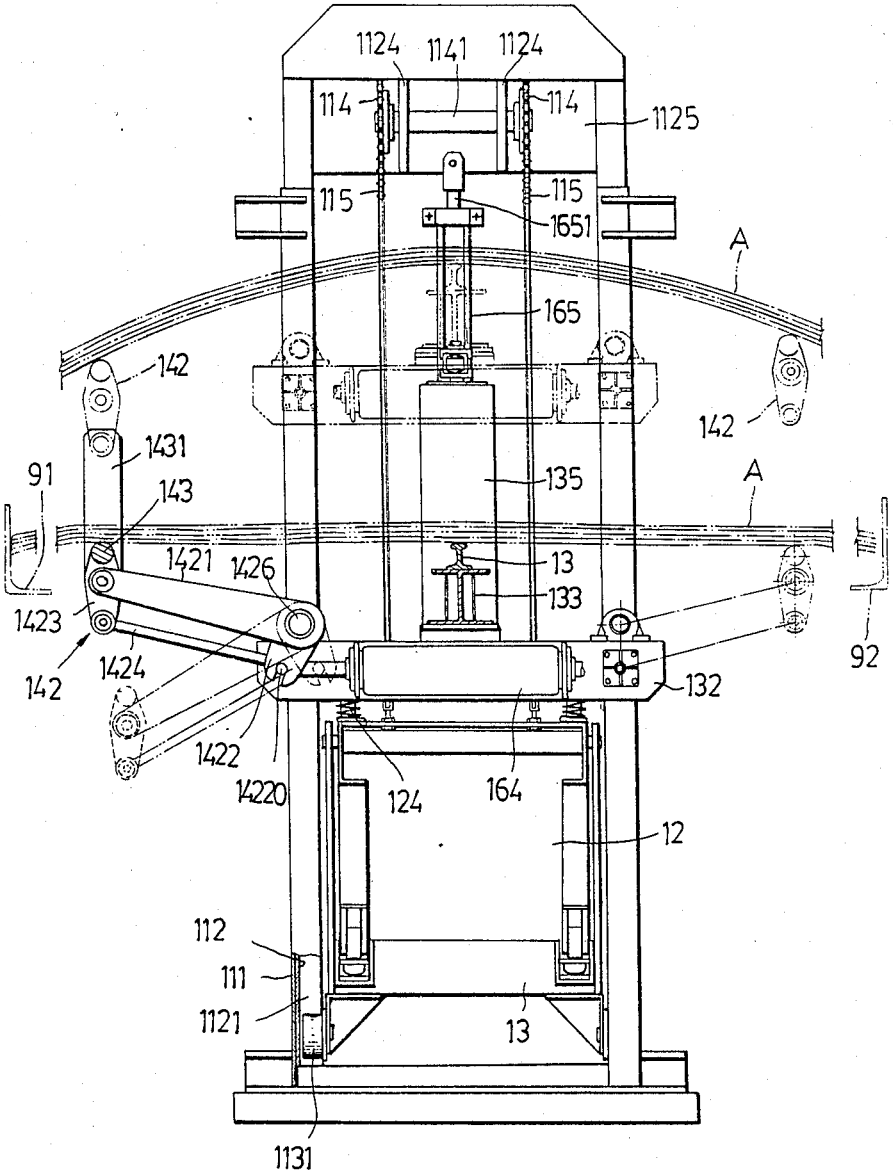
FIG. 4 is a front view of FIG. 3 in which the cantilever arm is removed and a portion thereof is a cross-sectional view taken along line A—A.

Referring to FIGS. 3 and 4, the rod bundle handling unit 1 includes a telescopic upright support 11, constituted of an outer hollow body 111 and an inner body 112 mounted slideably in the outer body 111. A carrier 113 is mounted slideably in the inner body 112 with its slide rollers 1131 received in two vertical slide rails 1121 provided at two sides of the inner body 112. The outer body 111 is provided with reinforcement plates 1110 and two mounting seats 1111 fixed at two sides of its top portion. Two chains 115 are fastened to the seats 1111 respectively and pass over two sprocket wheels 114 which are mounted on two ends of a shaft 1141, which in turn is mounted on two brackets 1124 of a support plate 1125. The ends of the chains 115 are fastened to the carrier 113 which can move upward and downward in the slide rails 1121.

A hydraulic cylinder 165 is connected to the base of the outer upright body 111 and the piston 1651 thereof is connected to the support plate 1125 so as to hold the inner upright body 112 in position and to move it relative to the outer upright body 111. When the inner body 112 is lifted by the hydraulic unit 165, the sproket wheels 114 ascend, lifting the carrier 113 through the chains 115. It can be appreciated that the carrier 113 ascends to a height twice that attained by the inner body 112 since the chains 115 pass over the sprocket wheels 114. Accordingly, the above arrangement gives an advantage in that, to lift the carrier 113 to a desired height, the actuating rod of the hydraulic unit 165 needs to extend upward only about one half of the height.

There is a platform 12 pivoted to the carrier 113 by means of pivots 121. The lower side of the platform 12 is slanted and is connected to a piston rod of a hydraulic unit 162 which is attached to the lower side of the carrier 113 to adjust the position of the platform 12 and to hold it in a desired position relative to the carrier 113.

On the top of the platform 12 are superimposed two spaced apart transverse support bars 131 and 132 on which an elongated support 133 is mounted longitudinally. A support beam 13 which is used to support rods A is supported longitudinally by the support 133. At the rear end of the beam 13 adjacent to the column 11 is a vertical fence plate 135 which keeps before it the rods placed on the beam 13.

There are a pair of rear arm assemblies 141 and a pair of front arm assemblies 142 attached to two end portions of the support bars 131 and 132 respectively. Two support rods 143 which will cooperate with the support beam 13 to hold the rods are placed across the rear and front arm assemblies 141 and 142 on both sides of the beam 13. At the rear end of each support rod 143 is provided a vertical fence member 1431 which keeps in front of it the rods held by the support rod 143.

The rear and front arm assemblies 141 and 142 are similar in construction and each of them includes a crank arm 1421 and a crank plate 1422 mounted pivotally on one end of the support bar 131 or 132 with a crank pin 1426. The end of the crank arm 1421 is pivoted to a connecting plate 1423 which in turn is connected to one end of the support rod 143 at its top side. The lower portion of the connecting plate 1423 is pivoted to a link 1424 which in turn is pivoted to the end of crank plate 1422 at point 14220. Two hydraulic units 164 are disposed respectively between the pair of arm assemblies 141 and the pair of arm assemblies 142. Each hydraulic unit 164 has two actuating rods extending towards and connected to the crank plates 1422 of the two arm assemblies for adjusting the position of the arm assemblies so that the support rods 143 can cooperate with the support beam 13 to hold the rods A in a stable position.

At the bottom sides of the support bars 131 and 132 are provided spring seats 123 and 124 which in turn are mounted on the top of the platform 12, and a vibrator 134, for instance, a vibro motor manufactured by Ye Feng Motor Co. Ltd., is mounted on support bar 133 for vibrating the support bar 133, support beam 13, and support arms 141 and 142 relative to the platform 12.

An advancing rotating roller 17 is mounted on the front end of the support bar 133 and is driven by power means (not shown) at an appropriate speed so as to advance the rods one after another and then send them onto the slider bars 2. In the periphery of the roller 17 are provided axial grooves 171 at intervals to receive and convey the rods A one after another.

To the top of the fence member 135 is fixed a cantilever arm 15 which includes a first section 151 that substantially extends horizontally and a second section 152 pivoted to the first section 151. A hydraulic cylinder 163 is connected to a bracket 1511 of the first section 151 and its piston rod 1631 is connected to a bracket 1521 of the second section 151 so as to adjust the position of the movable section 151 and hold it in a desired position according to the quantity of rods A on the support beam 13. The cantilever arm 15 is provided for holding movably a bundle of rods A against the support beam 13.

To the front end portion of the second section 152 of the cantilever arm 15 is attached a guide block 153 with two rollers 1531 at its bottom side which rest on the periphery of the advancing roller 17 to guide the advancing movement of the rods A. To the bottom side of the second section 152 is attached an auxiliary bent arm 154 which has a portion near the guide block 153 extending parallel relative to the surface of the support beam 13 and spaced apart therefrom to leave a narrow space 139 therebetween for passage of one rod A.

A space adjustment block 1551 is attached to the front end portion of the second section 152 and has a bottom face extending parallel relative to a portion of the support beam 13 which is slanted downward to the advancing roller 17 to define a narrow gap that extends from the narrow space 139 to the advancing roller 17 for passage of one rod A. The adjustment block 1551 has a threaded stem 1552 passing through the second section 152 and an adjustment threaded member 1553 sleeved around the stem 1552. By turning the adjustment threaded member 1553, the gap between the adjustment block 1551 and the support beam 13 can be adjusted according to the size of one rod A.

As shown by dotted lines in FIG. 4, when the support beam 13 ascends to a certain height, the mid portions of the rods A are lifted, causing the rods A to bent at their mid portions. Portions of the rods A are supported by the support rods 143 which are adjusted in height to cooperate efficiently with the support beam 13 so as to hold the rods A in a stable position. On two sides of the rod bundle handling unit 1 are restriction members 91 and 92 used for restricting the rods so that the rods are kept between the members 91 and 92. The restriction members 91 and 92 are upright bodies which are mounted movably on railroad 9 so as to move along the railroad 9 for adjustment of their distances from the rod bundle handling unit 1 according to the length of the rods.

Figure 5:
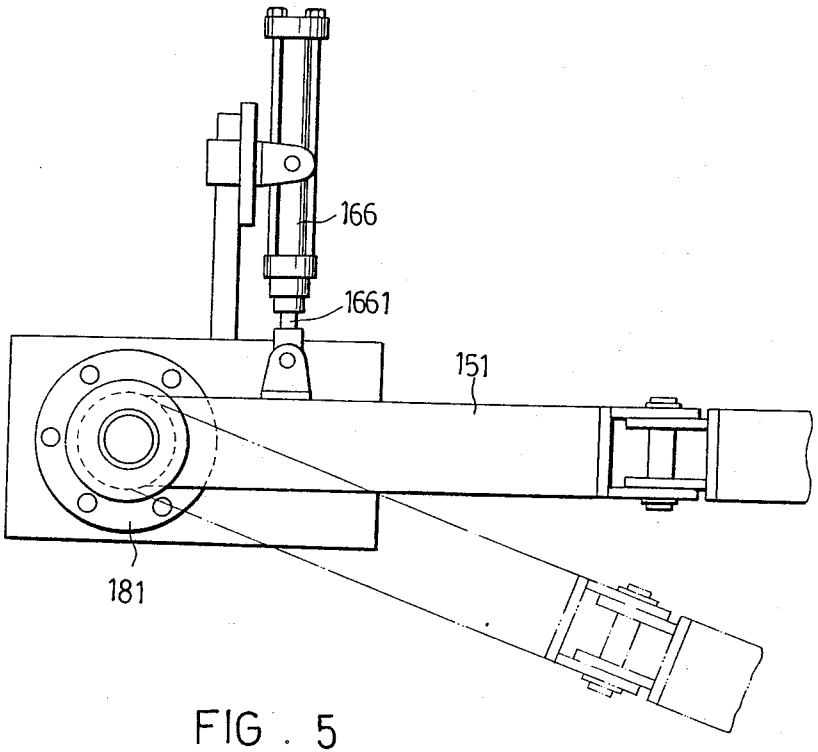
FIG. 5 is a top plan view further enlarged which shows schematically a portion of the cantilever arm of the rod bundle handling unit with a swivel means.

As described hereinabove, the second section 152 of the cantilever arm 15 can be moved upward and downward by the hydraulic power unit 163 so as to move towards and away from the advancing roller 17. In order to allow a bundle of rods A to be put by a crane on the support beam 13 from above the cantilever 15, the cantilever 15 is arranged in such a manner that it can rotate about a vertical axis to move away from above the support beam 13. This can be accomplished in any way that can be known by one skilled in the art. For example, as shown in FIG. 5, the section 151 of the cantilever arm 15 can be mounted on a swivel support 181 and rotated about a vertical axis by an actuating rod 1661 of a hydraulic cylinder 166 disposed at one side of the support beam 13. In operation, one can move the cantilever arm 15 away from the support beam 13 by first operating the hydraulic unit 163 to move the section 152 away from the roller 17, and then operating the hydraulic power unit 166 to turn the section 151 away from the the support beam 13.

After a bundle of rods A is put on the support beam 13 and on the support rods 143 and the rods are stabilized by the cantilever arm 15, the platform 12 is lifted to an appropriate height and adjusted to an appropriate inclination with respect to the carrier 113, and the support bars 131 and 132 are vibrated to move the rods away from one another and move them through the narrow gap towards the advancing roller 17 from which the rods are conveyed one after another to the slider bars 2.

Figure 6:
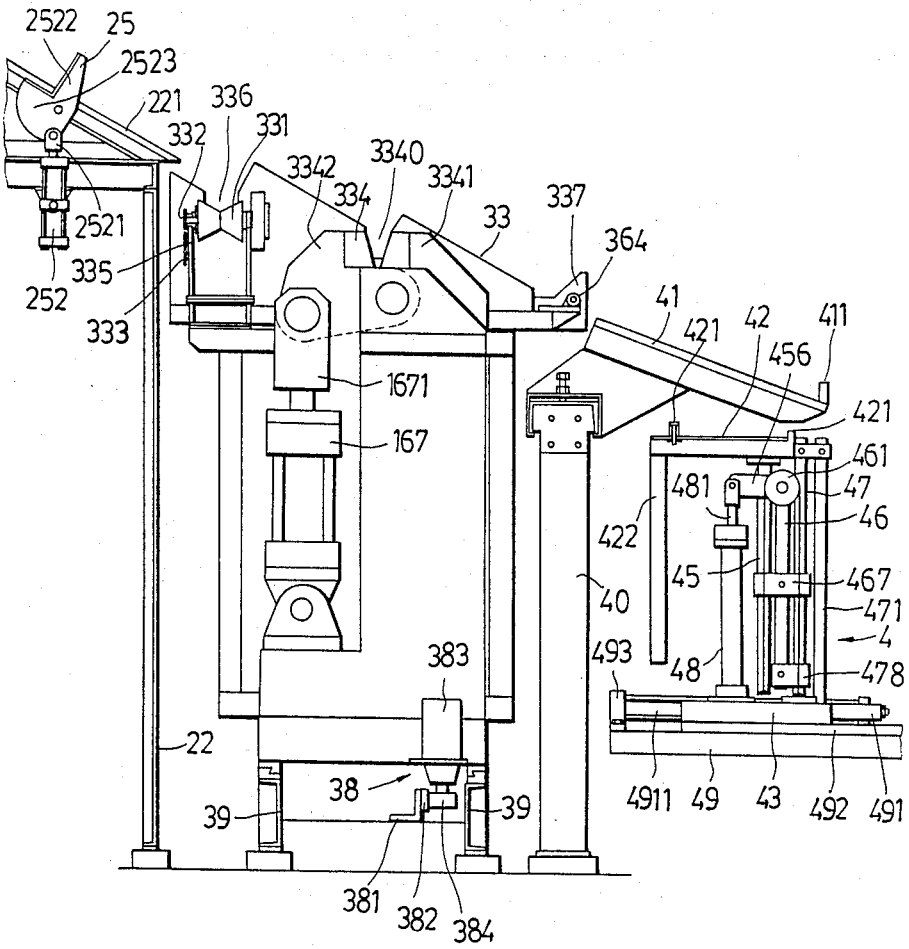
FIG. 6 is an enlarged side elevational and schematic view showing a cutting truck and related transfer means.
Figure 7:
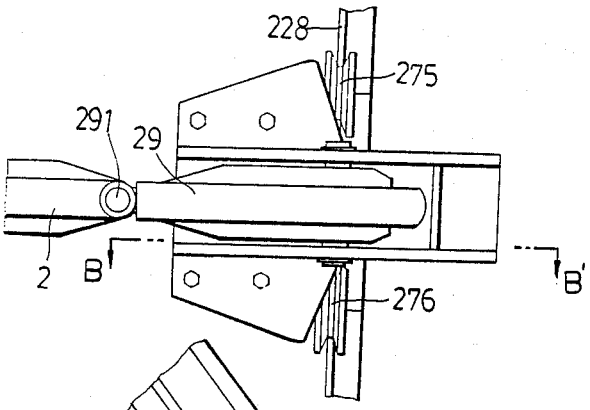
FIG. 7 is a schematic top plan view showing how a slider bar is connected to a slide body of an elongated support provided downstream of the rod bundle handling unit.
Figure 8:
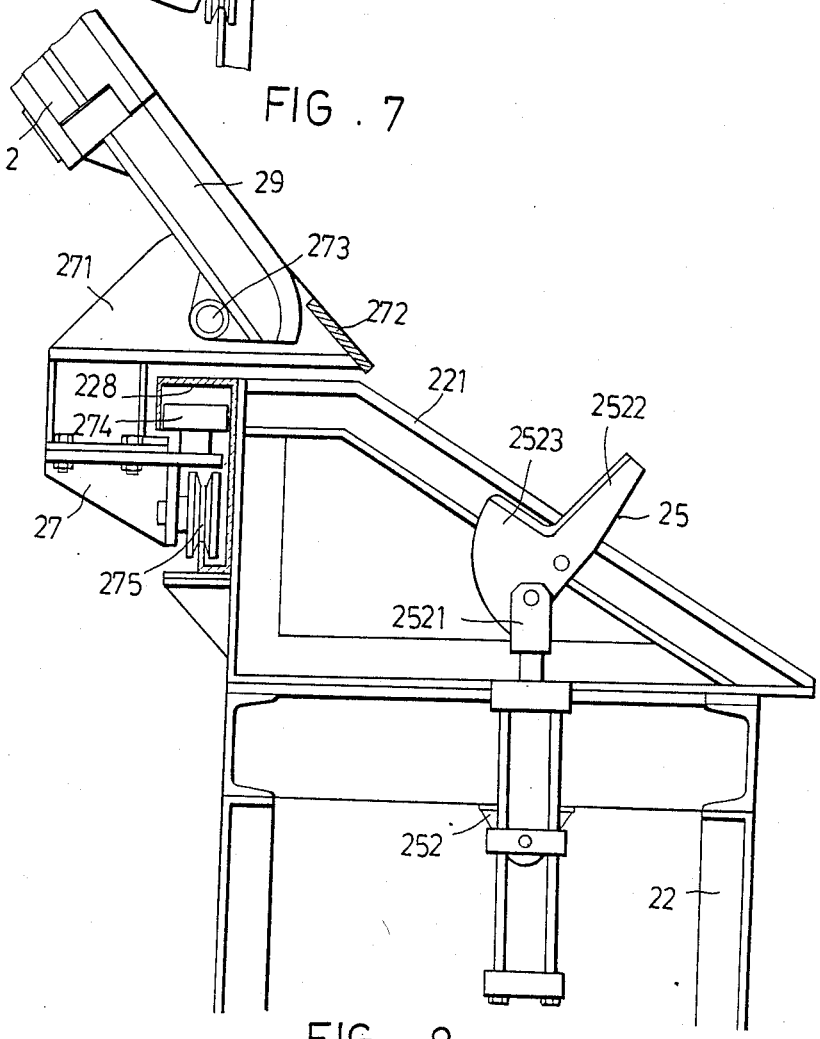
FIG. 8 is an enlarged side elevational and schematic view showing a top portion of the elongated support of FIG. 7.

Referring to FIGS. 6, 7 and 8 in combination with FIG. 1, the forward ends of the slider bars 2 are held movably by an elongated support frame 22 which extends transversely relative to advancing direction to the rods. The support frame 22 has at its top side a plurality of slider rods 221 inclining downwardly and forwardly. At the top rear side of the frame 22 is provided a slide rail 228 extending the full length of the frame 22. Slide bodies 27 are mounted in slide rail 228 at intervals to be connected movably with the sliding bars 2 respectively. Each slide body 27 has a top connecting seat 271 having an inclined surface 272 that lies almost in the same plane as the slider rods 221. To the seat 271 is pivoted a link member 29 by means of a pivot 273. Each sliding bar 2 is pivoted to an end of each link member 29 by means of a pin 291, thereby enabling the sliding bars 2 to turn about pin 291 and about pin 273. Preferably, the top of each connector seat 271 is provided with a rounded surface so that each sliding bar 2 can always cooperate with the inclined surface of the respective connector seats 271 to form a smooth sliding path within a range of inclinations changed as the height of the platform 12 is changed. Each slide body 27 further includes slide rollers 274, 275 and 276 disposed in the slide rail 228 so that the slide body 27 can slide along the slide rail 228 smoothly.

There are feeding arms 25 disposed at intervals on the support frame 22 for catching the rods one after another sliding down from the slider bars 2 and sending it to the cutting station. Each feeding arm 25 is forked and has prongs 2522 and 2523 which form substantially a right angle between them, and is mounted pivotally on the respective slider rod 221 and connected to an actuating rod 2521 of a hydraulic actuating unit 252 mounted on the support frame 22. The actuating rods of the hydraulic units 252 moves the feeding arms 25 respectively between a catching position and a releasing position. When the feeding arms 25 are in the catching position, the prongs 2522 project from the plane of inclination of the slider rods 22 to stop the rod from sliding, placing it in the right position ready to be fed to the next station. When the feeding arms 25 are in the releasing position, the prongs 2522 and 2523 of the feeding arms 25 turn clockwise, and release the rod A to continue sliding along the slider rods 221 to the cutting station.

Figure 9:
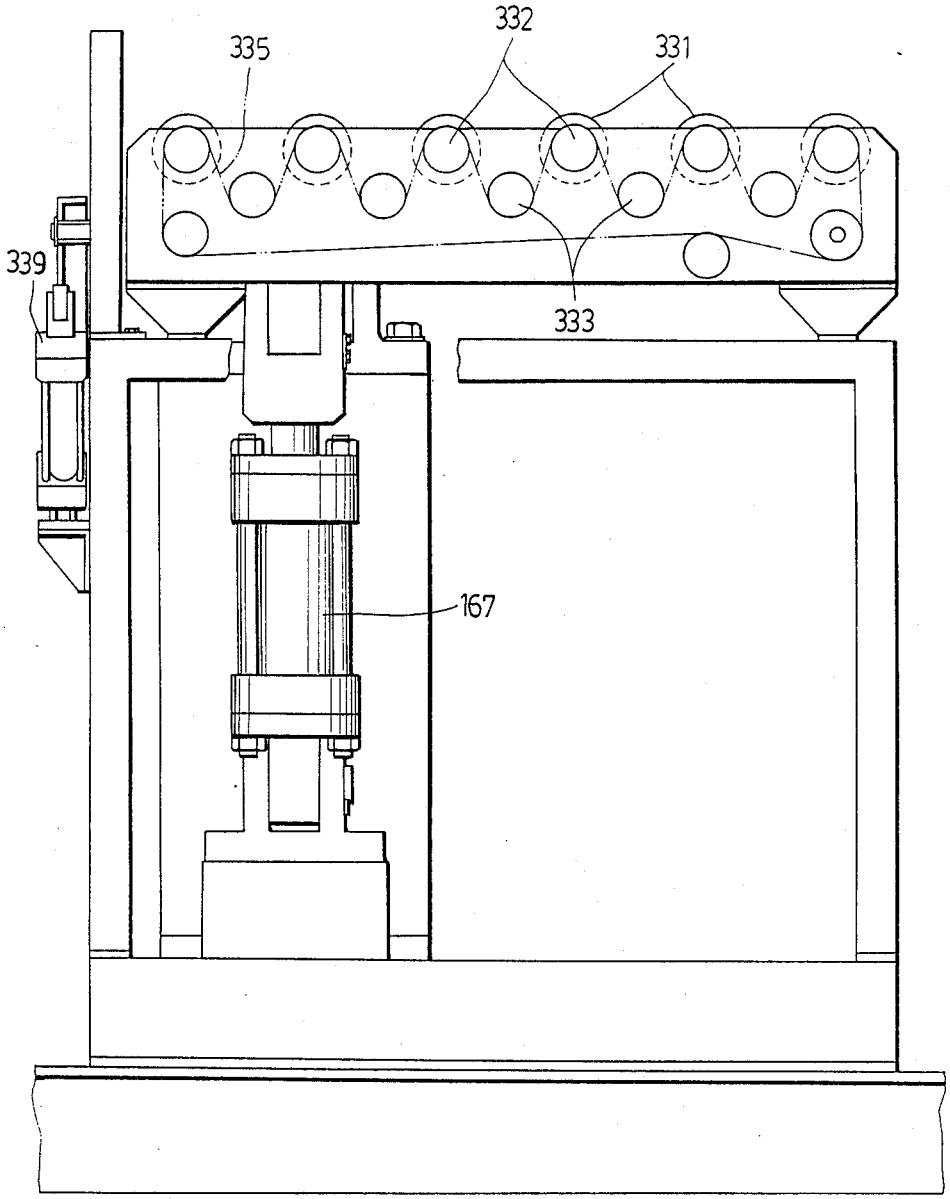
FIG. 9 is a front elevational and schematic view of the cutting truck of FIG. 6.
Figure 10:
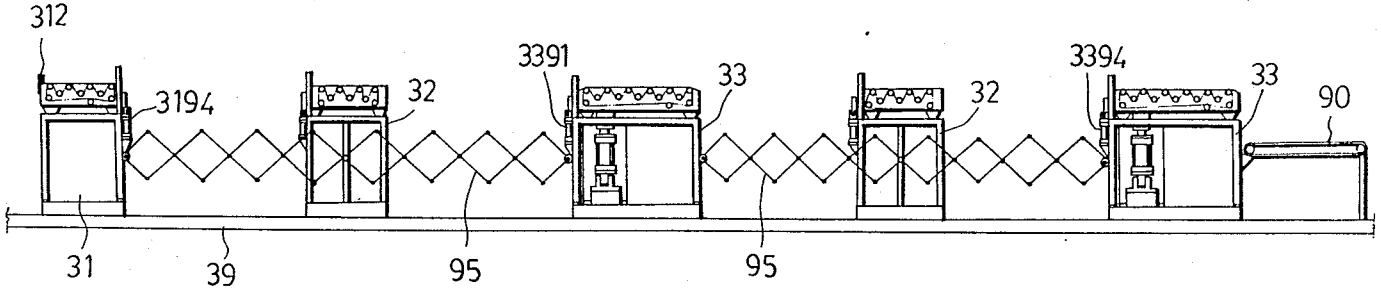
FIG. 10 is a side elevational view which shows schematically trucks arranged in the cutting station of the assembly.
Figure 11:
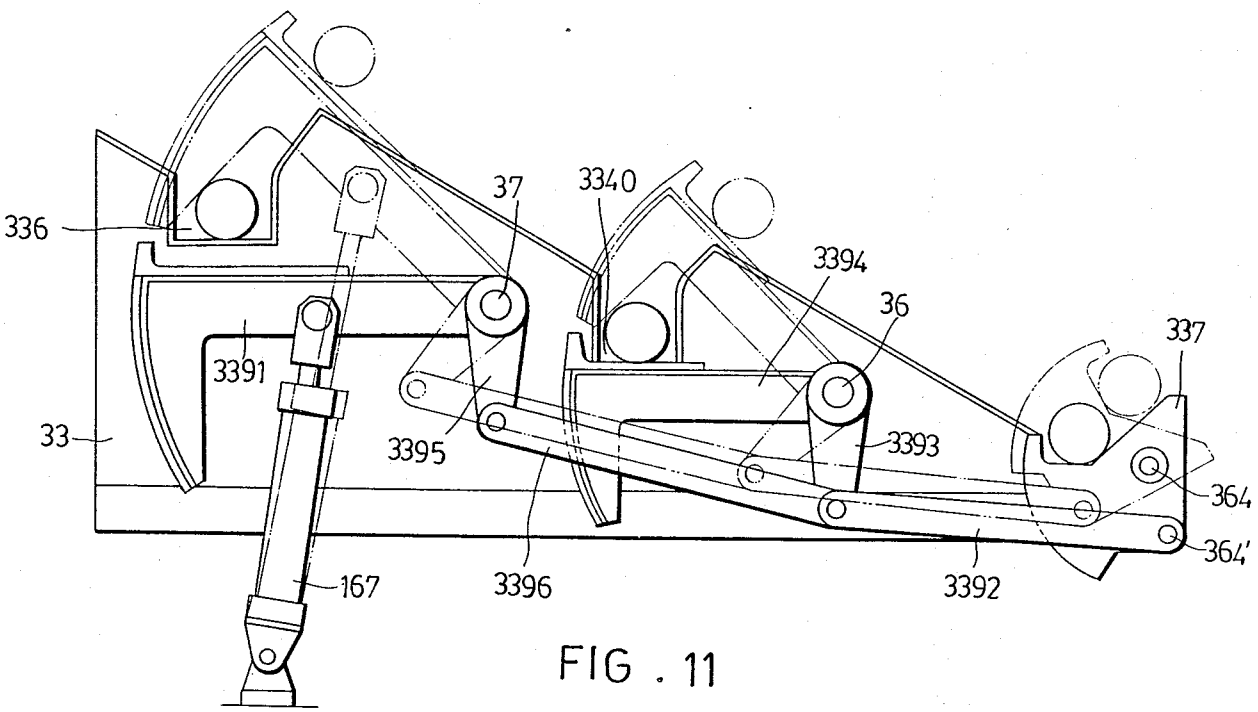
FIG. 11 is a side elevational view which shows schematically the ejector arms of the cutting truck of FIG. 6.

Referring to FIGS. 9, 10 and 11 in combination with FIGS. 1 and 6, the rod cutting station 3 has a rail path 39 transverse to the advancing direction of the rods. Along the rail path 39 are a positioning truck 31, two support trucks 32 and two cutting trucks 33 which are provided at predetermined intervals according to the length of the rods for cooperatively working on the rods. The trucks 32, 32 and 33 are coupled by means of an isocell drag link mechanism 95 to be maintained at a proper position relative to each other.

Each of the cutting trucks 33 includes a top inclined bed having a first transverse groove 336 and a second transverse groove 3340 downstream of the first groove 336. Shifting rollers 331 are mounted in the groove 336 for shifting and positioning the rod received in the first groove 336. A driving roller 332 is mounted coaxially with each roller 331. Guide rollers 333 and a driving belt 335 are also provided so that the series of the shifting rollers 331 can be driven through the driving belt 335 by a power means (not shown).

The second groove 3340 is adapted to receive the rod sliding along the bed from the first groove 336. In the second groove 3340 is a cutter means 334 which includes a fixed jaw 3341 and a movable jaw 3342. The movable jaw 3342 is provided with a replaceable cutting blade and the fixed jaw 3341 is provided with a replaceable anvil. An actuating rod 1671 of a hydraulic unit 167 is connected to the movable jaw 3342.

At the bottom side of each truck 33 are provided rollers which extend into the rail path 39 for rolling along the rail path 39 to adjust the position of each truck 33 relative to the other trucks according to the desired length of the rods to be cut. A driving means 38 is provided at the bottom side of each truck 33 for driving the truck 33, which includes a servo-motor 383 mounted on the truck 33, and a driving friction wheel 384 connected to the motor 383. There is a fixed guide bar 381 extending along the rail path 39. A friction plate 382 is attached to the guide bar 381 and contacted frictionally with the friction wheel 384, whereby the truck 33 can move transversely upon operation of the motor 383.

The construction of the support truck 32 is almost the same as that of the cutting truck 33 except that it has not cutting means 334 and drive mechanism 38. The construction of the positioning truck 31 is also almost the same as that of the truck 33 except that it has no cutting means 334 but has a positioning plate 312 attached to the positioning truck 31 adjacent to one end of the first groove of the positioning truck for stopping the rod which is moved by the rollers 331.

All support trucks 32 and cutting trucks 33 are located at one side of the positioning truck 31 opposite the side at which the positioning plate 312 is attached as shown in FIG. 10. The first grooves 336 of the trucks 31, 31 and 33 are aligned with each other so that they can receive cooperatively a rod to be positioned. The second grooves 3340 of the trucks 31, 32 and 33 are aligned with each other so that they can receive cooperatively a rod to be cut. Although the support trucks 32 are not provided with drive means, they can move simultaneously with the positioning truck and the cutting trucks since the trucks are interconnected.

The positioning plate 312 is used to position the rod to be cut so that the cutter means 334 of the cutting trucks 33 will cut the rod at a predetermined location. In operation, the rod received in the first grooves 336 of the trucks is moved by the shifting rollers 331 to the datum plate 312, and when the rod touches the positioning plate, a signal is produced to stop the motor (not shown) which drives the shifting rollers 331. Preferably, a magnetic clutch is employed in combination with the driving system of the shifting rollers 331. If the rod is short, only one cutting truck 33 is needed to cut the rod. As shown in FIG. 10, a collector 90 is provided at one side of the end cutting truck 33 for collecting and sending away the excess parts of the rods. There are ejector arms 3391 and 3394 at one side of the trucks 33 and ejector arms 3191 and 3194 at one side of the truck 31 for ejecting rods from the first groove 336 and the second groove 3340 of the trucks, respectively. FIG. 11 shows the ejector arms of a cutting truck 33, which are identical to the ejector arms of the positioning truck 31. The description of the ejector arms of the cutting truck 33 will serve to describe the ejector arms of the positioning truck 31.

As shown in FIG. 11, ejector arm 3391 and ejector arm 3394 are pivoted to one side of the truck 33 with crank pins 37 and 36 respectively. A hydraulic unit 167 is connected to the arm 3391 for raising 3391 and 3394 intermittently to a level above the bed of the truck 33 from a level below the first and second grooves 336 and 3340. One end of a crank arm 3393 is mounted on the crank pin 36, and one end of a crank arm 3395 is mounted on the crank pin 37. A lever 3396 is pivoted to outer ends of the crank arms 3393 and 3395. Another lever 3392 is pivoted to the crank arm 3393 and a transfer arm 337 at point 364'. The transfer arm 337 is mounted pivotally on the truck 33 by means of a pivot 364 above point 364'. When the ejector arm 3391 rises, the ejector arm 3394 also rises, ejecting the rods from the first and second grooves and letting them slide downward along the bed of the truck. The rod ejected from the first groove 336 slides to the second groove 3340, and the rod ejected from the groove 3340 slides down to the transfer arm 337.

When the ejector arm 3391 rises, the crank arms 3393 and 3395 turn clockwise and pull the levers 3392 and 3396, thereby turning the transfer arm 337 clockwise about pivot 364. Accordingly, the transfer arm 337 sends the rod to a next station. When the ejector arm 3391 is lowered, the transfer arm turns counterclockwise and receives a next rod.

Figure 12:
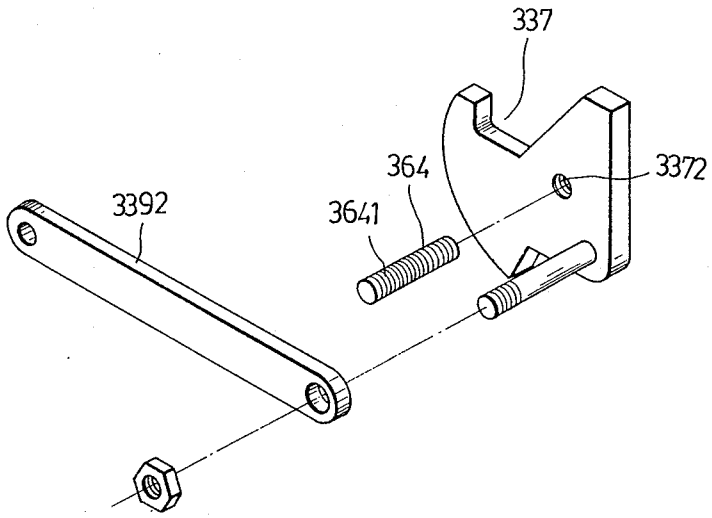
FIG. 12 is an exploded detail view of the transfer arm of the cutting truck of FIG. 6.

The transfer arms 337 of the trucks can be arranged in such a manner that they can position the cut rods before the cut rods are fed to the bending station. As shown in FIG. 12, the pivot rod 364 of the transfer arm 337 is provided with a screw thread 3641 and the pivot hole of the transfer arm 337 is provided with an internal screw thread 3372 to mesh with the threads 3641. When the arm 337 is turned about the pivot rod 364, it makes a simultaneous axial displacement, by the action of the screw threads, relative to the pivot rod 364 in a direction toward the positioning truck 31. It can be appreciated that, when a rod is cut by the two trucks 33, the cut part between the two trucks 33 will displace slightly in a direction that moves away from the positioning truck 31. With the transfer arms 337 arranged as described above, the displaced cut part can be moved slightly in a direction toward the positioning truck 31.

Figure 13:
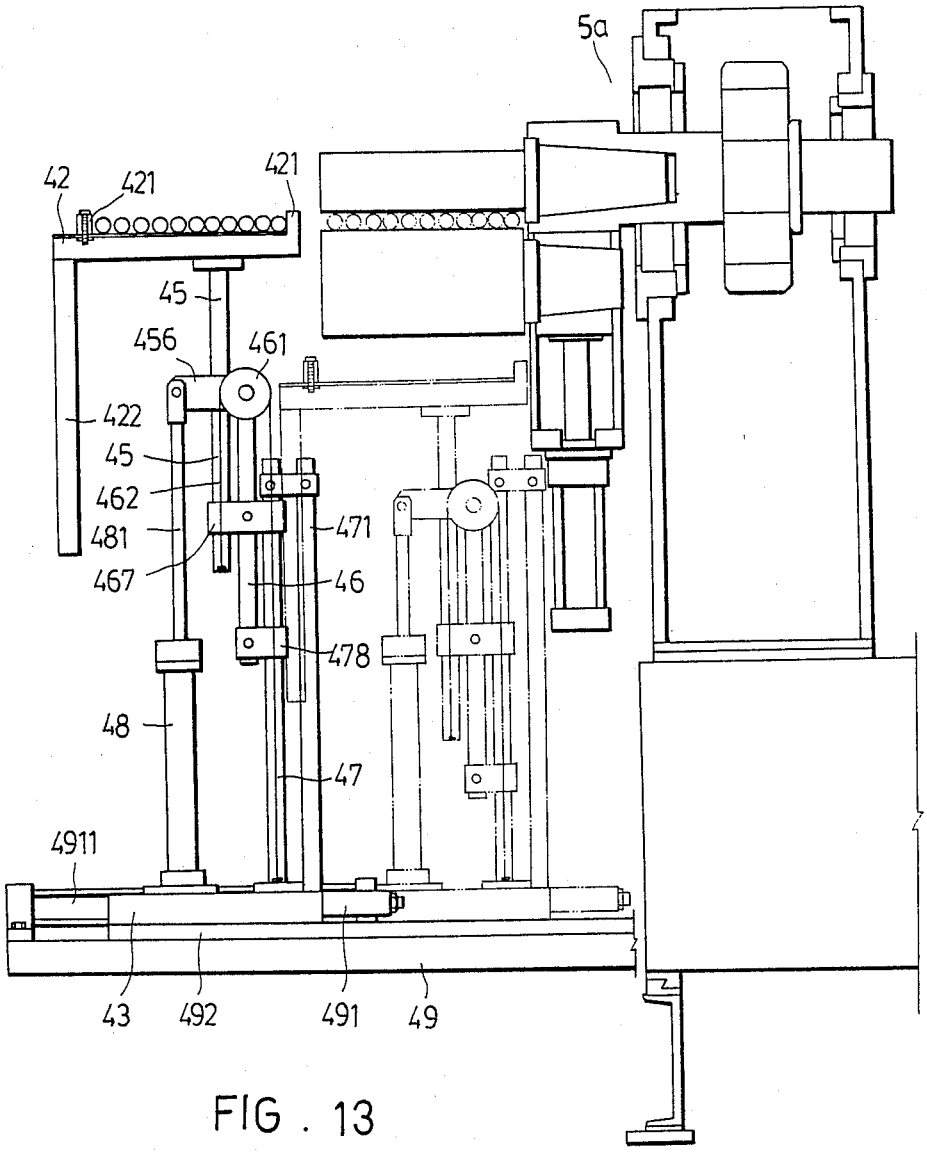
FIG. 13 is a schematic side elevational view showing a transfer truck of FIG. 6 further enlarged and a bending device.

Referring to FIG. 13 in combination with FIGS. 1 and 6, a long transverse support 40 has inclined sliding cantilevers 41 extending forwardly therefrom at intervals for collecting rods which are delivered from the transfer arms of the trucks 31, 32 and 33. Each inclined cantilever 41 has a stop member 411. The rods from the transfer arms 337 of the trucks slide along the cantilevers 4 and are piled thereon neatly because of the stop member 411. When a certain amount of rods are collected on the cantilevers 41, the rods are taken by transfer trucks 4 provided at intervals.

Each of the transfer trucks 4 is provided near to a respective cantilever 41 and has a platform 42 with a front stop member 421 and a rear stop member 422. The platforms 42 can be raised intermittently to a level higher than the cantilevers 41 from a level lower than the cantilevers 41 to lift the rods from the cantilevers 41 and be moved forward and rearward to carry the rods to the bending station 5 from the cantilevers 41. Each transfer truck 4 further includes a base 43 slideably mounted on a railroad 492 of a base seat 49 and is provided with a hydraulic cylinder 491 with an actuating rod 4911 which is mounted on the base seat 49 and actuates the truck 4 to move forward or rearward along the railroad 492.

The platform 42 of each truck 4 is raised by an actuating rod 481 of a hydraulic cylinder 48 through a lifting mechanism. The actuation rod 481 of the hydraulic cylinder 48 extends upward and is fixed to a block 456 which in turn holds a pulley 461. The pulley 461 is fixed to the top end of a lifting rod 46 of which the bottom end is attached with a guide block 478. The block 478 in turn is sleeved around slideably a stationary post 47 extending upright from the base 43. Near the post 47 is a reinforcing post 471 which is mounted on the base 43 and is connected to the post 47 at its top side to strengthen the post 47. A guide block 467 is attached to the mid portion of the lifting rod 46 and is provided with through-holes (not shown) receiving the post 47 and a further lifting rod 45 on two sides of the rod 46. The bottom end of the lifting rod 45 is fixed to one end of a chain 462 which passes over the pulley 461 and is fastened to the base 43 at its other end.

When the actuating rod 481 of the hydraulic cylinder 48 lifts the pulley 461, the chain 462 pulls the bottom end of the lifting rod 45 upward, thereby raising the platform 42. The lifting mechanism so arranged has an advantage in that the actuating rod 481 can lift the platform 42 to a desired height by rising only to a height half as much as the height to which the platform 42 is lifted.

When the platforms 42 of the trucks 4 are raised to a level as high as clamping means of rod bending devices **5*a* and 5*b* provided in the bending station 5, the trucks 4 are moved forward to approach the bending units 5*a* and 5*b***, which are provided at intervals. After the trucks deliver the rods to the bending devices, the trucks are lowered and then moved backward to proceed with the next operating cycle.

Figure 14:
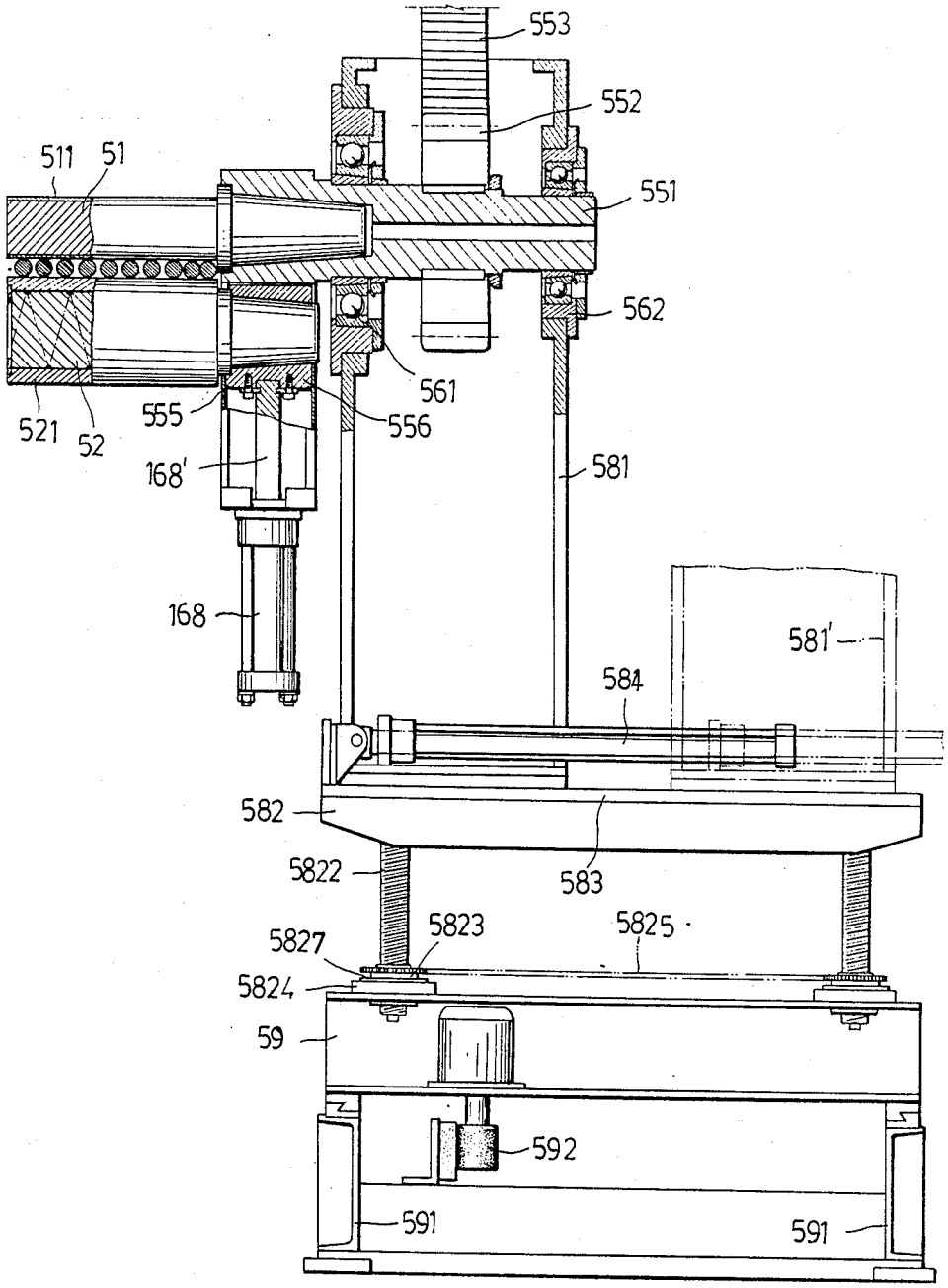
FIG. 14 is a side elevational view partly in cross-section of a bending device of FIG. 13 wherein the pressure bending arm of the device is provided below the bearing arm.
Figure 15:
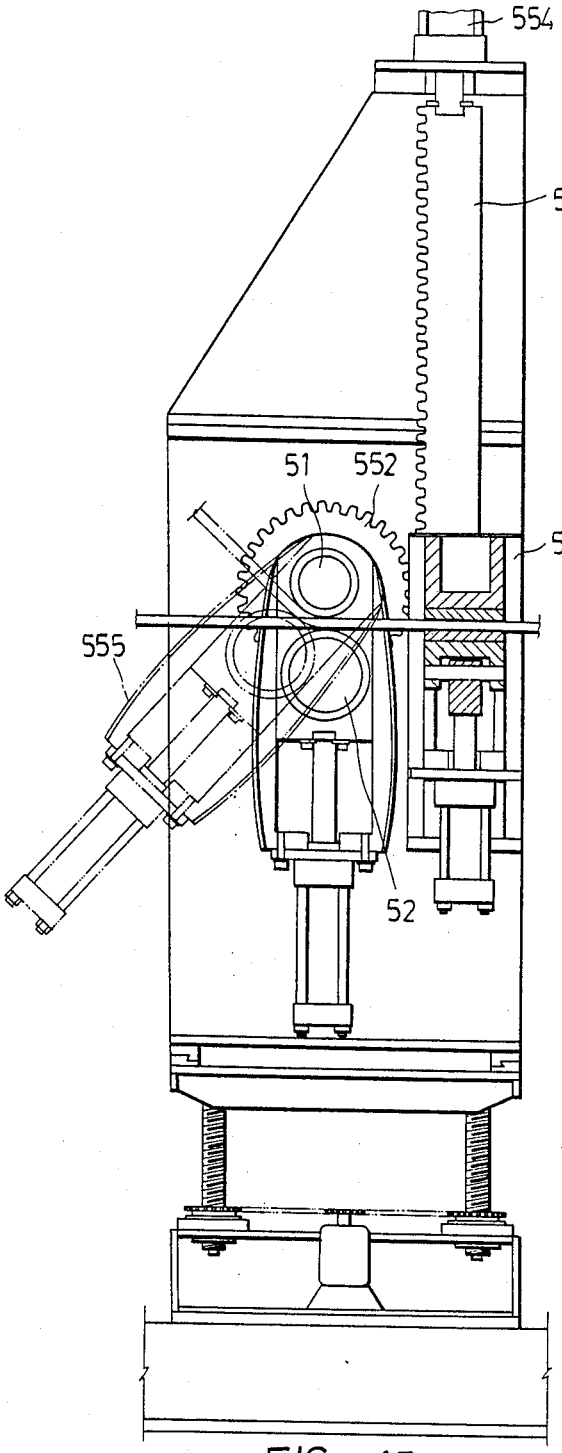
FIG. 15 is a front elevational view of the bending device of FIG. 14.

Referring to FIGS. 14 and 15 in combination with FIG. 1, each of the bending devices **5*a* has a machine frame 581 which is mounted movably on a support 582 having a rail path 583 along which the machine frame 581 can be moved forward and rearward by means of a hydraulic power unit 584 mounted on the support 582. The support 582 is in turn mounted on a base 59 movably mounted on a railroad 591 which extend transversely in the bending station. A drive mechanism 592 is attached to the support 582 to drive controllably the support 581 along the railroad 591. The mechanism 592 is identical to the drive mechanism 38 of the cutting truck 33 or the positioning truck 31**.

Figure 17:
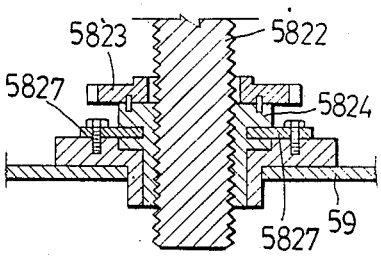
FIG. 17 is an enlarged cross-sectional view of a portion of an adjustable leg of the bending device of FIG. 15 or 15A.

At the bottom side of the supports 582 are adjustable legs 5822 for adjustment of the height of the machine frame 581. As better shown in FIG. 17, each leg 5822 is provided with an external screw thread and is inserted in a seat 5824 which has an internal thread meshing with the screw thread of the leg 5822, the seat 5824 being prevented from rotation by using locking members 5827. The seats 5824 are mounted on the base 59. An adjusting sprocket 5823 is fixed to each leg 5822 and is driven by a chain 5825 for turning and adjusting the leg 5822. The chain 5825 is driven by a power means (not shown).

On the machine frame 581 is mounted a horizontal shaft 551 through bearing assemblies 561 and 562. A driven gear 552 is sleeved on the shaft 551 and meshed with a driving rack member 553. The driving rack 553 is connected to a hydraulic power unit 554 for driving the gear as well as the shaft 551. On the rear portion of the shaft 551 which extends rearward is mounted a cylindrical rotary bearing arm 51. A sleeve 511 is sleeved movably onto the bearing arm 51, such as by providing oil passages between the sleeve 511 and the bearing arm 51. A support frame 555 is mounted on the rear portion of the shaft 551 in a radially downwardly extending position and has a movable support body 556 holding a pressure bending arm 52. A sleeve 521 is sleeved rotatably on the pressure arm 52. The support body 556 is connected to an actuating rod 168' of a hydraulic unit 168 to be held movably in a slide way of the support frame 55. The hydraulic unit 168 can adjust the position of the support body 556 by moving radially the support body 556 toward or away from the bearing arm 51 so that the pressure arm 52 is spaced properly from the bearing arm 51 according to the cross-sectional dimension of the rods to be bent. The space between the pressure arm 52 and the bearing arm 51 is arranged in such a manner that it is larger than the diameter of a rod to be bent. The pressure arm 52 of each bending unit **5*a* can be rotated clockwise or counter-clockwise about the axis of the shaft 551 simultaneously with the rotation of the bearing arm 51** to bend the rods upward.

Figure 16:
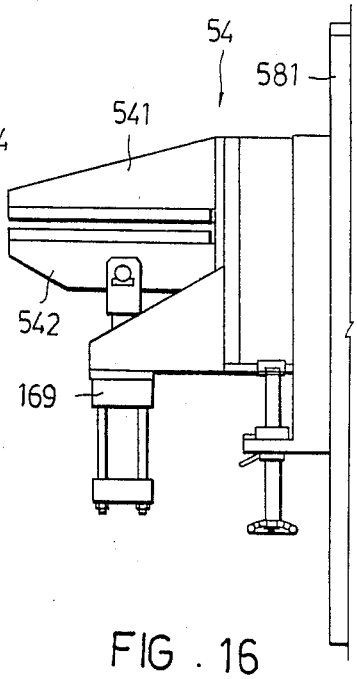
FIG. 16 is a side elevational view of a clamping means of the bending device of FIG. 15.

Adjacent to the bearing arm 51 and the pressure arm 52 is a clamping means 54 extending from the machine frame 581. As shown in FIG. 16, the clamping means 54 includes rearwardly extending upper fixed jaw 541 and lower movable jaw 542. The upper fixed jaw 541 is fixed to the machine frame 581 and has a clamping face at the same height as the lower side of the periphery of the bearing arm. The lower movable jaw 542 has a clamping face opposite the clamping face of the fixed jaw 541 and is held movably by a hydraulic drive unit 169 which is mounted on a support of the machine frame 581.

Figure 15A:
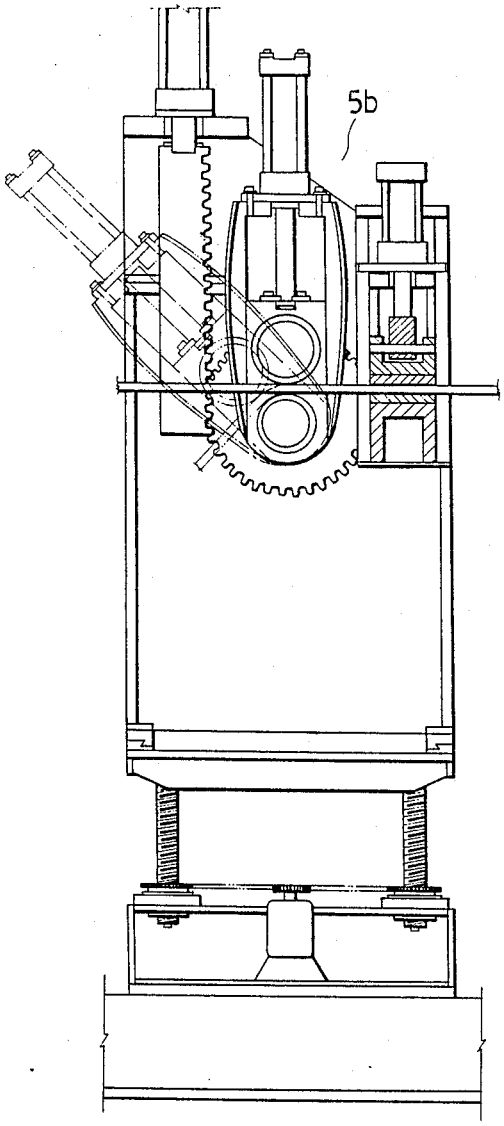
FIG. 15A is a view similar to FIG. 15 of another embodiment of a bending device in which the pressure bending arm is provided above the bearing arm.
Figure 16A:
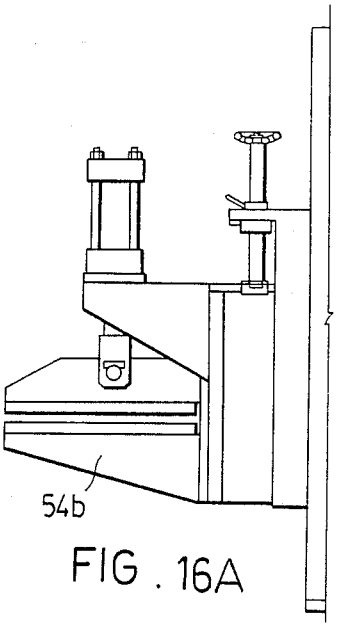
FIG. 16A is a side elevational view of a clamping means of the bending device of FIG. 15A.

The construction of the bending device **5*b* is substantially similar to that of the bending device 5*a* except that the pressure arm of the bending device 5*b* is mounted above the bearing arm, as shown in FIG. 15A, so as to bend the rod downward. In the clamping means of the bending device 5*b*, the fixed jaw is provided below the movable jaw (see FIG. 16A) so as to match the arrangement of the pressure arm and the bearing arm. In operation, the clamping jaws are opened so as to receive the rods when the transfer trucks 4 move toward them and deliver the rods. In this situation, the rods held by the platforms of transfer trucks 4 are level with the space between the pressure bending arms and the bearing arms and thus inserted between the pressure bending arms and the bearing arms. After, the jaws are closed to clamp the rods, and the transfer trucks 4** are lowered and moved rearward to continue the next cycle of operation, leaving the rods between the jaws and the pressure and bearing arms of the bending devices. The rods left in the bending devices are bent by the pressure and bearing arms.

Figure 19:
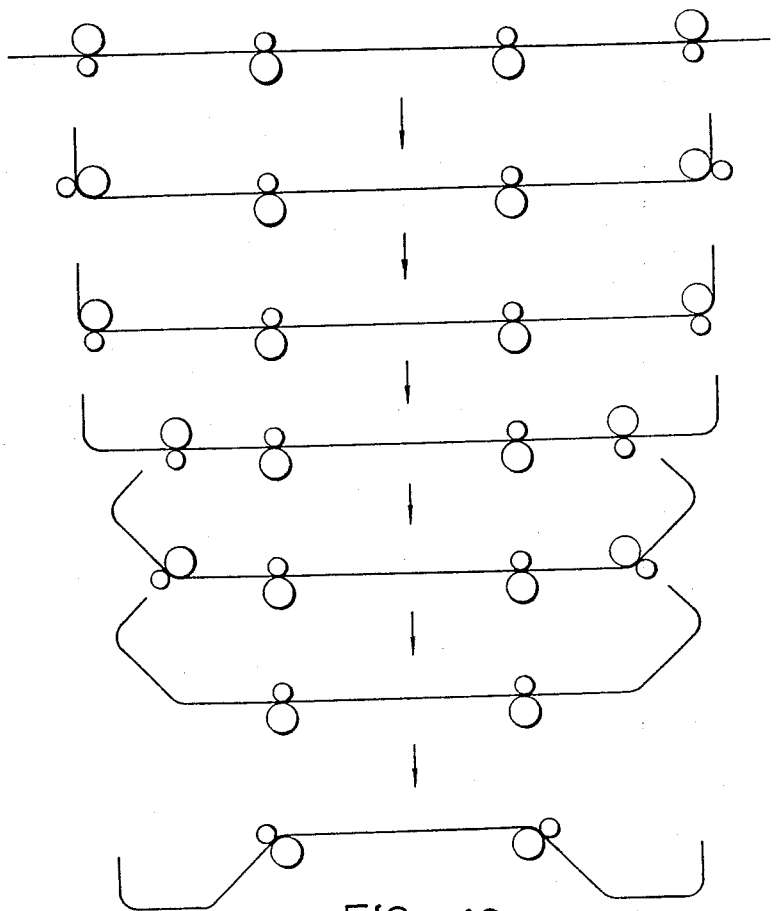
FIG. 19 is a schematic view which shows how a rod is bent by four bending devices.
Figure 18:
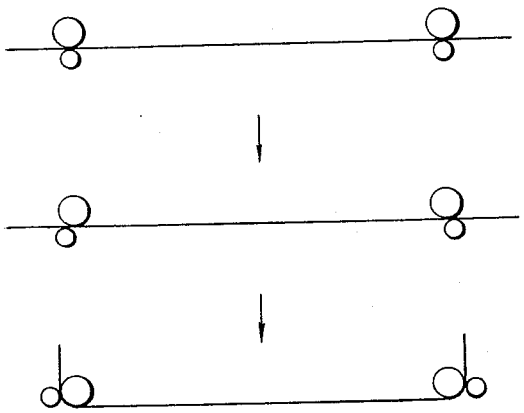
FIG. 18 is a schematic view which shows how a rod is bent by two bending devices.

Referring again to FIG. 1, there are two groups of bending devices **5*a* and 5*b* to bend two cut rods resulting from two cutting trucks provided upstream. The left group includes two bending devices 5*a*, and the right group includes two bending devices 5*a* and two bending devices 5*b* between the two bending devices 5*a*. FIG. 18 shows schematically how a rod is bent by two bending devices 5*a*, and FIG. 19 shows schematically how a rod is bent by two bending devices 5*a* and two bending devices 5*b* provided between the two bending devices 5*a*. In the case of FIG. 19, the rods clamped by the bending devices 5*a* and 5*b* are bent progressively from the portions near their two ends to their mid portions. Each outermost bending device 5*a* bends each rod upward at two points by first bending the rod at the outer one of the two points and then moving inward and bending the rod at the inner point. Afterward, the bending devices 5a move forward out of alignment with the inner bending devices 5b as soon as the former finish the bending operation so as to allow the inner bending devices 5b** to proceed with bending the remaining portions of the rods.

Figure 2:
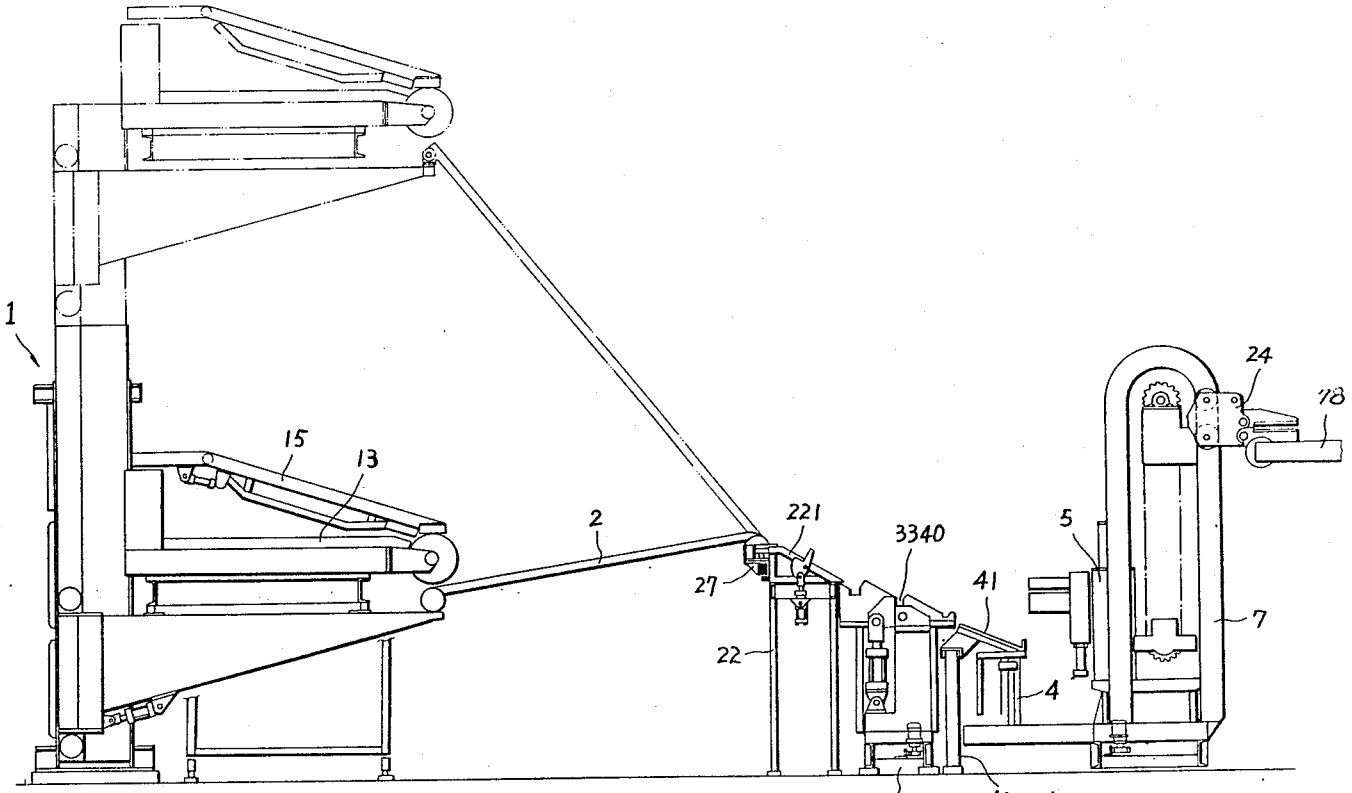
FIG. 2 is a schematic side elevational view of the machine assembly from the left of FIG. 1.
Figure 20:
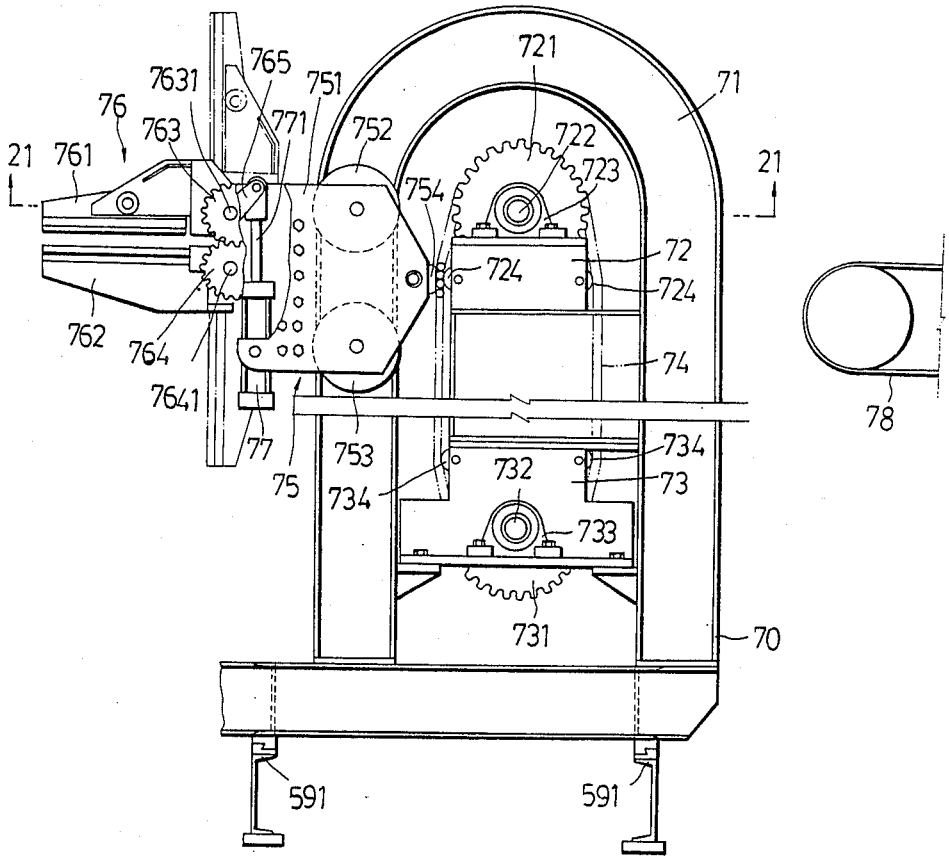
FIG. 20 is a schematic side elevational view of a take-out device.
Figure 21:
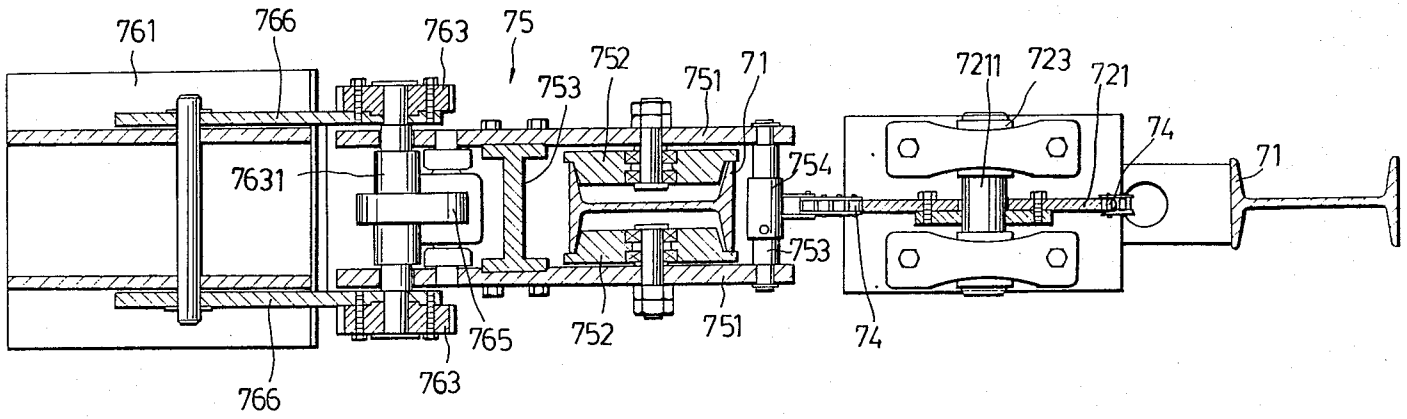
FIG. 21 is a cross-sectional view taken along line 21—21 of FIG. 20.

After the rods are bent by the bending devices 5b, they are taken out from the clamping means and the pressure and bearing arms of the bending devices by take-out devices 7 which are provided adjacent to the respective bending device on the same railroad 591. Referring to FIGS. 20 and 21 in combination with FIG. 2, each take-out device 7 includes a machine frame 70 with an endless chain 74 passing over an upper sprocket 721, a lower sprocket 731, and guide rollers 724 and 734. The sprocket 721 is mounted on a shaft 722 which is mounted on a support 72 through bearing assemblies 723. The sprocket 731 is mounted on a shaft 732 which is mounted on a support 73 through bearing assemblies 733. An arched rail 71 is provided on the machine frame 70 extending from the rear side to the top side and then to the front side of the frame around the moving path of the chain 74. The arched rail 71 is formed from a curved bar of I-shaped cross-section having two opposite grooves extending its full length.

A moving support body 75 is provided to move along the arched rail 71. The moving body 75 includes two plates 751 disposed on two sides of the arch rail 71 sandwiching the rail 71 and fastened together by tie means 753. Rollers 752 are attached to plates 751 and received in rail grooves of the arched rail 71. On the tie means 753 at the inner tapered ends of the plates 751 is provided a connector 754 which is connected to the chain 74 at a certain location so that the plates 751 can be moved along the rail 71 by the chain 74. Mounted between the outer ends of the plates 751 are shafts 7631 and 7641. On the ends of the shafts 7631 and 7641 are mounted gears 763 and 764 respectively. A crank 765 is mounted on the shaft 7631 for turning about the axis of the shaft 7631 and is connected to an actuating rod 771 of a hydraulic cylinder 77 so as to drive the shaft 7631 and gear 763 meshing with gear 764. Two upper crank arms 766 are mounted on the shaft 7631 for holding movably an upper jaw 761 which forms a part of clamping means 76 of the take-out device 7. Similarly a lower jaw 762 is held movably by two lower crank arms ( not shown) mounted on the shaft 7641. When the shaft 7631 is driven, gears 763 and 764 as well as shaft 7641 are rotated to move the jaws 761 and 762 between an open position and a closed position.

When the bent rods are clamped between the clamping means of the bending devices 5a and 5b, the jaws 761 and 762 of the take-out devices 7 adjacent to the bending devices are opened as shown in phantom, and the support bodies 75 of said take-out devices 7 are moved downward to be level with the clamping means of the bending devices. Then the jaws 761 and 762 close and clamp the bent rods. At this moment, the clamping means of the bending devices open and the bending devices move forward, leaving the bent rods between the clamping jaws of the take-out devices. The bent rods clamped by the jaws 761 and 762 of the take-out devices are then delivered at the forward side of the machine frame 70 when the jaws 761 and 762 are moved to the forward side along the arched rail 71 and are opened. After delivery, the jaws 761 and 762 return to the rear side for carrying the next group of rods. Numeral 78 represents a conveyor belt to convey the rods delivered from the take-out devices.

With the invention thus explained, it is apparent that various modifications and variations can be made without departing from the scope of the invention. It is therefore intended that the invention be limited only as indicated in the appended claims.

I claim:

1. A process for separating and feeding long metal rods comprising:

providing a rod support having an inner end and an outer end;

placing a plurality of rods on the support with the longitudinal axes of the rods extending transversely to the support;

restricting the position of the ends of the rods to maintain the middle portions only of the rods on the support;

raising the support so that the rods are supported at the middle portions thereof in a bent condition;

inclining the support from the inner end thereof to the outer downstream end thereby sliding the rods downwardly along the support in the feed direction of the rods toward the outer end of the support;

vibrating the support upwardly and downwardly;

providing a gradually restricting space and a following uniformly restricted space for the rods above the support toward the outer downstream end of the support;

passing the rods through the gradually restricted space and then the uniformly restricted space in a direction substantially transverse to the longitudinal axes of the rods; and removing the individual rods from the support in a direction transverse to the longitudinal axes of the rods.

2. A process for bending long metal rods comprising:

providing a rod support having an inner end and an outer end;

placing a plurality of rods on the support with the longitudinal axes of the rods extending transversely to the support;

restricting the position of the ends of the rods to maintain the middle portions only of the rods on the support;

raising the support so that the rods are supported at the middle portions thereof in a bent condition;

inclining the support from the inner end thereof to the outer downstream end thereby sliding the rods downwardly along the support in the feed direction of the rods toward the outer end of the support;

vibrating the support upwardly and downwardly;

providing a gradually restricting space and a following uniformly restricted space for the rods above the support toward the outer downstream end of the support;

passing the rods through the gradually restricted space and then the uniformly restricted space in a direction substantially transverse to the longitudinal axes of the rods;

removing the individual rods from the support in a direction transverse to the longitudinal axes of the rods;

feeding the rods to a cutting station by sliding the rods in the feeding direction transverse to the longitudinal axes of the rods;

shifting each rod in the direction of the longitudinal axis thereof a predetermined distance to place each rod in alignment with at least one cutting member;

moving each rod in the aligned position to cutting position;

cutting each rod in the cutting position;

providing at least one bending station downstream in the feeding direction of said cutting station;

providing at least one cut rod collecting and feeding member and collecting a predetermined number of cut sections of each rod and feeding them to the art least one bending unit;

moving the cut sections of the rod in the direction of the longitudinal axis of the rod a predetermined distance to align at least one of the cut sections with the at least one bending unit;

bending the at least one aligned cut rod section; and removing each bent rod from the at least one bending unit.

3. A process as claimed in claim 2 wherein:

said bending step comprises bending each cut rod section upwardly in at least one vertical plane.

4. A process as claimed in claim 2 wherein:

said bending step comprises bending each cut rod section downwardly in at least one vertical plane.

5. A process as claimed in claim 3 wherein said bending step comprises:

bending each rod progressively from a position near at least one of the ends of the rod to a position away from at said at least one end, each rod being bent upwardly prior to being bent downwardly so that the bend portions of the rod are prevented from contacting a floor on which the machine is based during the bending operation.

6. A process as claimed in claim 2 wherein said bending step further comprises:

clamping immovably a portion of each rod during said bending to prevent said clamped portion from changing its position until the bending operation is completed so that the risk of disordering the bent rods is eliminated.

* * * * *